US007325386B2

(12) United States Patent
Kissling

(10) Patent No.: US 7,325,386 B2
(45) Date of Patent: Feb. 5, 2008

(54) DOUBLE ACTION VERTICAL FORM-FILL-SEAL APPARATUS

(76) Inventor: Etienne Kissling, 2420 Joshua Ave., Clovis, CA (US) 93611

( * ) Notice: Subject to any disclaimer, the term of this patent is extended or adjusted under 35 U.S.C. 154(b) by 0 days.

(21) Appl. No.: 11/540,196

(22) Filed: Sep. 29, 2006

(65) Prior Publication Data

US 2007/0084154 A1 Apr. 19, 2007

Related U.S. Application Data

(60) Provisional application No. 60/727,898, filed on Oct. 17, 2005.

(51) Int. Cl.
*B65B 9/20* (2006.01)

(52) U.S. Cl. ..... 53/551; 53/554; 53/202; 53/451

(58) Field of Classification Search ..... 53/202
See application file for complete search history.

(56) References Cited

U.S. PATENT DOCUMENTS 2,918,769 A * 12/1959 Anderson et al. ..... 53/546
3,641,737 A * 2/1972 Tamagni ..... 53/554
4,552,613 A * 11/1985 Auer ..... 156/515
5,408,807 A * 4/1995 Lane et al. ..... 53/551
5,460,844 A * 10/1995 Gaylor ..... 426/394
5,822,949 A * 10/1998 Naoi ..... 53/55
6,006,501 A * 12/1999 Davis et al. ..... 53/451
6,233,903 B1 * 5/2001 Ide ..... 53/141
6,598,377 B2 * 7/2003 Takahashi ..... 53/550
6,761,016 B1 * 7/2004 Soleri ..... 53/554
6,928,794 B2 * 8/2005 Hamer et al. ..... 53/450
6,966,166 B2 * 11/2005 Kissling ..... 53/451

* cited by examiner

*Primary Examiner*—John Sipos

(57) ABSTRACT

This is a double acting, multi-lane machine and method for the forming, filling and sealing of plastic or paper film pouches of various sizes commonly used to hold liquid viscous, dry, particulated or powdery materials or other substances. The machine includes a four roll film dispensing station, a multi unit pump or dispensing station, one of each double acting stations such as side seal station, pull wheel station, cross seal station, and cross cut station. The invention provides for production of a multitude of pouches in a manner of two sets of two films allowing to double the production output of current machinery without any change to cycle time or increase of operational time. Coordination and movement of the various stations is accomplished through electronic computer control, working in conjunction with multiple motion controlling devices such as servo motors, air cylinders, belts, linkages and the like. The machines stations and components are adjustable or interchangeable so that pouches of various lengths and widths may be formed.

8 Claims, 10 Drawing Sheets

Section View

DOUBLE ACTION VERTICAL FORM-FILL-SEAL APPARATUS

This application claims the benefit of U.S. Provisional Application No. 60/727,898, filed on Oct. 17, 2005.

BACKGROUND OF THE INVENTION

1. Field of the Invention

The present invention relates to an apparatus for manufacturing pouches made of webbed plastic, foil, or paper film, and more particularly, to an apparatus for forming, filling and sealing such pouches or sachets utilizing a double action apparatus allowing to double the output or production of current apparatuses or machines without the need to increase the cycle speed or operational time of the machine.

2. Description of the Prior Art

Pouches, also known as packets or sachets are commonly used throughout many industries to package and distribute individual single serve or institutional portions of liquids or viscous materials, as well as dry, particulated and or powdery materials, such as condiments, foods, beverages, pharmaceutical, personal care products, and chemicals. Such single serve or institutional size pouches are also used to package and distribute other products or commodities, such as candy, nuts, salt, pepper, rice and the like. The widespread popularity of such single serve or institutional pouches, combined with the convenience and their ease of distribution, has led to a ever increasing interest in machines and methods for forming, filling and sealing such pouches in a much more efficient way combined with and increased production output.

The traditional apparatus for manufacturing pouches uses two rolls for dispensing sheets of webbed foil or plastic film, of equal dimensions, multiple sealing devices appropriate for such film, and means for inserting such product into the film pouches. The apparatus first receives film from the film rolls, then matches and aligns their respective edges. The sealing devices are then applied to all but one of the edges, forming a pouch or sachet with a cavity and topside opening. The products (liquids, viscous materials, particulated or dry powdery products or substances) are then released and inserted into the cavity through the opening. The pouch or sachet opening is then closed, sealed and separated from the film. This process is then repeated.

Nonetheless, such traditional apparatuses are generally unsuitable for manufacturing large volumes of pouches at very high speeds. To be specific, traditional apparatuses are using two film dispensing rolls, one for the front creating the front part of the pouch cavity and one for the back creating the back of the pouch cavity. The machine stops every cycle while the side and/or leading and trailing edges of the pouches are pressed, sealed, and cut. With every delay (i.e., stop) without any action even only for a few milliseconds per cycle, these delays or stops accumulate over time and create a significant shortfall of product output resulting in decreased revenue for the manufacturer utilizing such apparatuses.

Various devices have been developed to increase the production rate of such film pouches. For example, U.S. Pat. No. 4,726,171 utilizes a vertically moving combination advancement-sealing-separation mechanism that travels between various locations within the apparatus, advancing the film from the film roll, sealing the ends of a pouch, or separating a pouch from the fill, depending upon the particular engagement point. U.S. Pat. Nos. 4,004,397 and 6,178,719 both utilize rotary presses and sealers to minimize delays in the pouch manufacturing process.

Unfortunately, none of these devices are particularly suited for very high-volume production of film pouches. None of the devices disclose an apparatus capable of a double action alternating sequence during operational cycles, in that the apparatus uses four rolls of film and produces, two sets of pouches in an alternating sequence per cycle. While one set of pouches are stationary and are in the sealing and cutting sequence of the cycle, the other opposing or second set of pouches are in a advancing and filling sequence of the cycle. This happens repeatedly in an alternating sequence every cycle of the machine. While the first set of two films are stationary during the first sequence of operation, concurrently the second set of two films are being advanced during the fill sequence of its cycle, until such set is ready and in a position to be stopped and horizontally sealed and cut. Such alternating operation sequencing makes the apparatus capable of producing two times the amount of product output in comparison to the existing single stage apparatus currently on the market.

Hence the desire to provide an apparatus for forming, filling and sealing large volumes of film pouches within a minimal amount of time. It is further desirable that such film pouches be manufactured in an alternating sequence and speed rate so as to maximize production volume. It is further desirable that the apparatus be capable of simultaneously manufacturing multiple film pouches per machine cycle, so as to further maximize production volume. It is further desirable that such film pouches are produced with no-leakage or breakage. It is further desirable that the apparatus is of small footprint and utilizes a minimal amount of operational floor space.

SUMMARY OF THE INVENTION

The present invention is a double action, multi-lane method and apparatus for the forming, filling and sealing of film, plastic, foil or paper pouches or sachets of various sizes commonly used to hold fluids, liquids, viscous materials (e.g. ketchup, mayonnaise, salsa, etc.), dry products in form of particulated or powdery materials (e.g. peanuts, candy, sugar, salt, peper etc.) or other substances. The invention is made up of the following distinct stations: a four film roll station; a multiple pump station; a double action side seal station; a double action pull wheel station; a double action cross seal station; and a double action cross cut station. The invention provides a production of multiple pouches or sachets by utilizing one or more moveable double action carriages. These carriages independently supporting each of the double action side sealing, double action cross sealing and double action cross cutting apparatuses. Coordination of the various stations movements is accomplished through electronic computer control (e.g., PLC), working in conjunction with multiple units of motion imparting devices such as servo motors, belt systems, air cylinders, linkages and the like. The various components of the machine are interchangeable or adjustable so that pouches of various lengths and/or widths may be formed using the same machine.

Two pair of film dispensing rolls are provided at the film roll station. Film is removed from each roll and used to form the fronts and backs, respectively, of the pouches. Sheets of film from all four rolls are advanced through the apparatus by the double action pull-wheel station. The film from each roll is guided so that all four sheets of film ending up in pairs and close proximity to and in a parallel relationship with one another as they are advanced through the machine.

The pump station consisting of multiple fill dispensers. These dispensers are capable of drawing a pre-determined quantity of material or product from an overhead reservoir or piping and depositing such material or product into the cavities of the film pouches formed by the machine. The pump stations and dispensers are each driven by one motion-controlled servomotor. The quantity of dispensed product may be changed by changing the stroke distance of the pistons contained within the pump. Exchanging the dispensers (with different dispensers having more or less capacity), also allows for larger or smaller product output not within the dispensing range of the first dispensing unit. This allows for different quantities of materials to be dispensed depending upon the size and capacity of the pouches to be formed by the machine.

In one embodiment, a servo motor and gearbox translate a rotary motion into a linear motion through a vertically arranged belt and pulley system, which allow the pumping pistons to move in a linear up and down motion. This upwards linear vertical motion of the pistons draws product into the cylinder body's of the pump station, by reversing this vertical motion of the pistons the product is discharged into a set of fill tubes which, in turn, dispense the product into the formed pouches. The servomotor allows the motion of these pistons to be controlled very precisely which controls the product flow. The amount of product can be varied by increasing or decreasing the stroke length of the piston.

The quantity of product to be deposited into the film pouches is communicated to the pump station servomotors and its controller, adjusting their movement accordingly, by entering or changing a setting into the electronic control panel operated by the machine operator.

The double action side seal station consisting of two sets of two opposing sealing frames, both sets positioned in such a manner that the two sets of film one front and one back films each advance between each of the two sets of the two opposing pads. A plurality of linearly vertically oriented sealing pads, each pad containing a heating element, are affixed to each frame forming a multiplicity of pairs of pads. The sealing pads are each aligned in close proximity to each of the corresponding opposing sealing pad on the opposing frame, and are arranged along the path of the film through the machine. Each pair of opposing pads is positioned so as to apply heat and pressure to the two films between them, causing the contacted surface areas of such films to be pressed together and sealed. The double action side seal station forms multiple seals. Once the front set of sealing pads are in the seal cycle of the operation using the front set of front and back films creating a seal, while at the same time, the rear set of sealing pads are retracted or open allowing the rear set of film with the just completed seals with the set of rear front and back films to advance to the next station. The motion is then reversed and repeated. This movement may be driven by one motion-controlled servomotor, or with a double stage air cylinder.

The double acting pull wheel station consisting of two sets of two opposing rotating roller shafts containing multiple pull wheels, both sets are positioned in such a manner that the two sets of two films each is capable of paired and independent advancement between the opposing shaft. The shafts may be retracted/opened so that the two sets of two films may be fed between them. When the shafts are in a closed position, pressure is applied to the rollers of each pair so that they come into contact with each other, pinching the films between them. This pinching action provides a gripping friction upon the film surfaces pulling the films through this station. The double acting pull wheel station is driven by two independent motion-controlled servomotors, each driving a pair of shafts with said pull wheels attached.

The double action cross seal station consisting of two sets of two opposing sealing frames, both sets positioned in such a manner that the two sets of films, one front and one back film, each advance between each of the two sets of the two opposing pads. Two opposing horizontally oriented pairs of sealing pads each pad containing a heating element, extending across the film path, are affixed to each set of frames. The sealing pads are aligned in close proximity to the corresponding sealing pad on the opposing frame, and are arranged across the path of the film. Each pair of opposing pads is positioned so as to apply when closed heat and pressure to the films between them, causing the contacted surface areas of such films to be pressed together and sealed. The double acting cross seal station forms a single seal each across the two sets of two films forming simultaneously the bottom of the set of pouches to be filled as well as the top/closing of the previously filled set of pouches. Once the front set of sealing pads are in the seal cycle of the operation closing and sealing the just filled set of pouches, the rear set of sealing pads, at the same time, are retracted/open allowing the rear set of just completed seals to advance and fill the just created set of top open pouches. The motion is then reversed and repeated. This movement may be driven by one motion-controlled servomotor, or with a double stage air cylinder.

The double acting cross cut station consisting of two sets of cutting devices/knifes positioned to receive the formed, filled and sealed pouches from the double acting cross seal station. The devices/knifes are capable of separating each row of pouches by cutting along the midpoints of the horizontally sealed surface areas created by the double acting cross seal station above. During the front set of knifes cutting cycle the rear set of knifes is retracted/open allowing the rear set of just completed filled and sealed pouches to advance and be positioned to be cut. The motion is then reversed and repeated. This movement may be driven by one motion-controlled servomotor, or with a double stage air cylinder.

The flexibility and independence of the machine and its various stations permits the operator to adjust and or set up the machine to create pouches of different horizontal and vertical dimensions, dos changing the fluid capacity, lengths and widths of the pouches. This is accomplished by adjusting such values as the quantity of product pumped into the pouches, the number and spacing of the side seals (defining the number of pouches per row and the frequency of cross seals (defining the length of the pouches), the movements of the servomotors, belts and pulley ratios of the system, etc.

In use, four sheets or two pairs of film in close proximity to each other are pulled from four large film dispensing rolls through the double acting side seal station through and by the rollers of the double acting pull wheel station. The two sets of films are parallel to and each other and each set is in close proximity with, one another, such that the first set or front set of two films may form, for example, the fronts of the pouches, while the second forms the backs thereof, while the second set of two films or rear of machine set of films form, for example, the fronts of the pouches, while the second forms the backs thereof. Activation of the front set of rollers of the double acting pull wheel station causes the rollers to advance the front set of two films to advance and unwind film from the first set of two dispensing rolls, while the other side or back side of machine of the double acting pull wheel station is halted and is awaiting a signal from the controller to advance the second set of films. Before each of the two sets of films is pulled through the double acting side seal station, they are aligned and pass along either side of two sets of a multiple fill tubes used to deposit the product into the top open or 3 sided pouches. Thus, the side seals are formed around the fill tubes.

At the double acting side seal station, containing a multitude of pairs of longitudinally elongated heated sealing pads, which when come together then apply pressure and heat upon the contacted film surfaces areas, causing the affected surfaces to adhere to one another creating multiple continuous vertical fill tubes, thereby defining cavities between the continuous fill tubes. The number and width of these fill tubes is determined by the distance between the vertically oriented and elongated heated sealing pads. Each of these cavities surrounds one of the fill tubes.

The double acting side seal station first forms a front set of multiple pouches, by applying sufficient momentary pressure upon the affected film surface area for a sufficient time to bond the two sides of film together at such contact area, while at the same time the rear set of film and previously formed elongated tubes are being advanced. This process is then reversed, repeated and so on. Each set of film front and rear forming multiple continuous longitudinal cavities or tubes of film. Each set of sealed film, now in the form of multiple tubes, continues, to be pulled in an alternating front set of films and then back set of film by the double acting pull wheel station, and advances to the double acting cross seal station. It is to be noted that during subsequent cycles, there is a moderate overlap of the sealed area of the tubes where the heating pads of the double acting side seal station will seal over the previously created side seals in order to provide continuous side seals on the films and to avoid any leakage of pouches.

Two sets of multiple, vertically oriented blades are provided along the film path just ahead of the double acting pull wheel station, with each blade ahead (above) of each pull wheel (pair). These blades are positioned at the mid-points of each of the freshly created side seals, in order to cut and separate the two sealed film sheets into multiple individual vertical tubes as they are pulled through the double acting pull wheel station. These separated tubes are then transferred to the double acting cross seal station.

The two sets of sealing pads of the double action cross seal station are mounted horizontally and perpendicularly to those of the double action side seal station. These cross sealing pads apply heat and pressure to the film across a transverse section of the surface area, causing the affected surfaces to adhere to one another in a perpendicular relationship to the continuous vertical longitudinal tubes formed by the double action side seal station. In the first cycle, such perpendicular adhesion defines the leading edge of a row of individual film pouches. In subsequent cycles, each such perpendicular adhesion defines both the trailing edge of the pouches of the current cycle, as well as the leading edge of the pouches of the subsequent cycle. As heat and pressure at the front of machine set of films is applied, the rear of machine set of film and set of sealing pads are open allowing the rear set of films to be advanced to the next station. The action of the double action seal station is then reversed and the rear set of sealing pads are applying heat and pressure to the rear set of films creating a horizontal seal, while the front set of sealing pads are open allowing the film to advance to the double acting cross cut station. This process is then reversed and repeated on and on.

Once a cross seal is formed, the pre-measured amount of product contained within the pump station then is deposited into the cavities of the film pouches through the fill tubes.

The top edge of the current row of just filled pouches being sealed by the double acting cross seal created in the subsequent cycle, also creates the bottom seals for the next set of pouches which was also created by the subsequent cycle.

The double acting cross cut station separates a horizontal row of each of the two individual set of films front and back of machine by cutting the pouches along the midpoint of the cross seal for each front and back film. The side seals between the now-filled film tubes of each row were previously cut by a multiplicity of vertical blades ahead of the double acting pull wheel station. Following the cross cut, the now separated and individual pouches then exit from the machine onto a takeoff conveyor or into a hopper or other appropriate receptacle.

It is therefore the primary object of the present invention to provide methods and apparatus for forming, filling and sealing large volumes of pouches in a minimal amount of time.

It is another object of the present invention to provide methods and apparatus capable of simultaneously manufacturing multiple filled pouches, so as to further maximize the volume of production.

It is another object of the present invention to provide an apparatus that utilizes a minimal amount of operational floor space.

DETAILED DESCRIPTION

Figure 1:
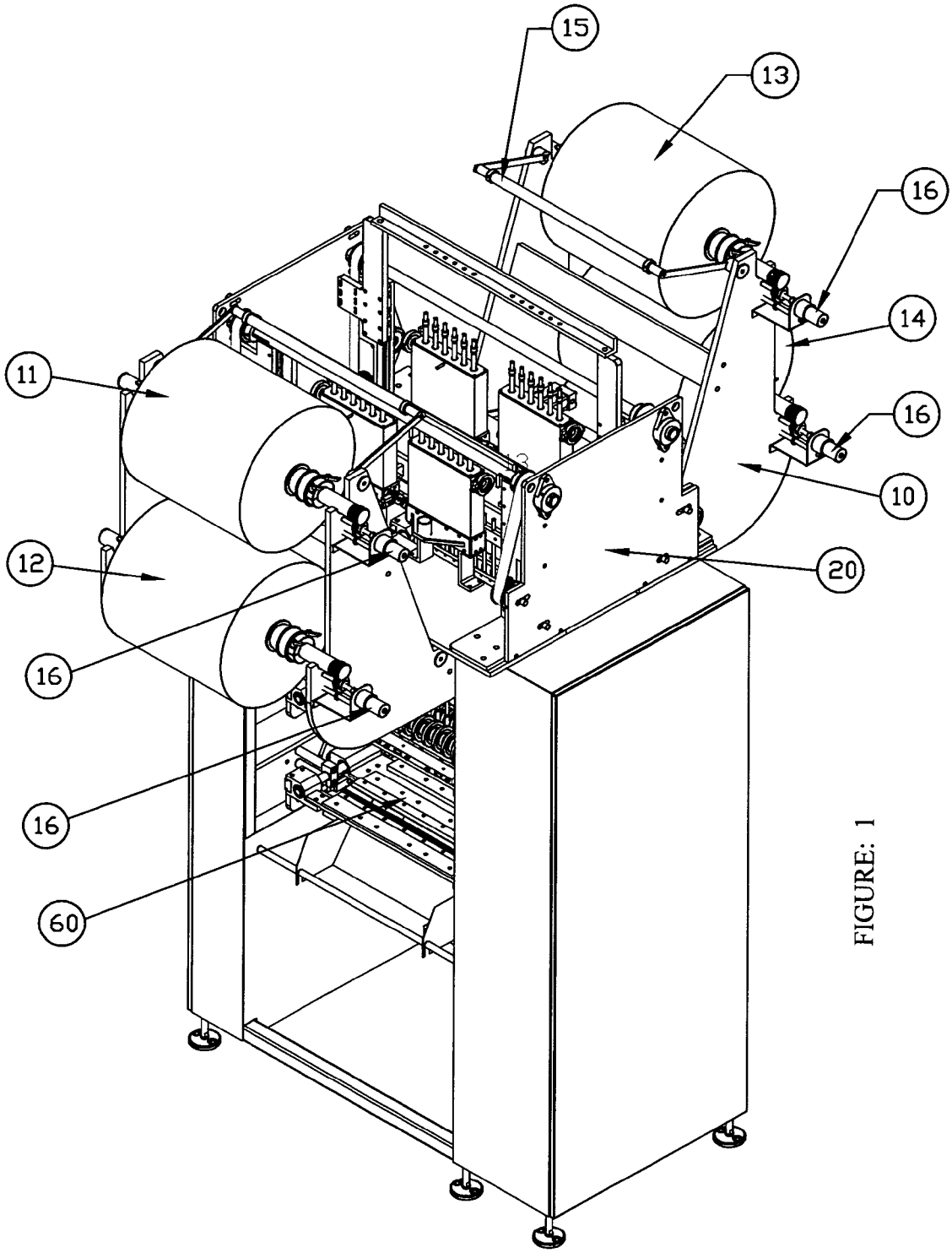
FIG. 1 is an isometric view of the present invention.
Figure 2:
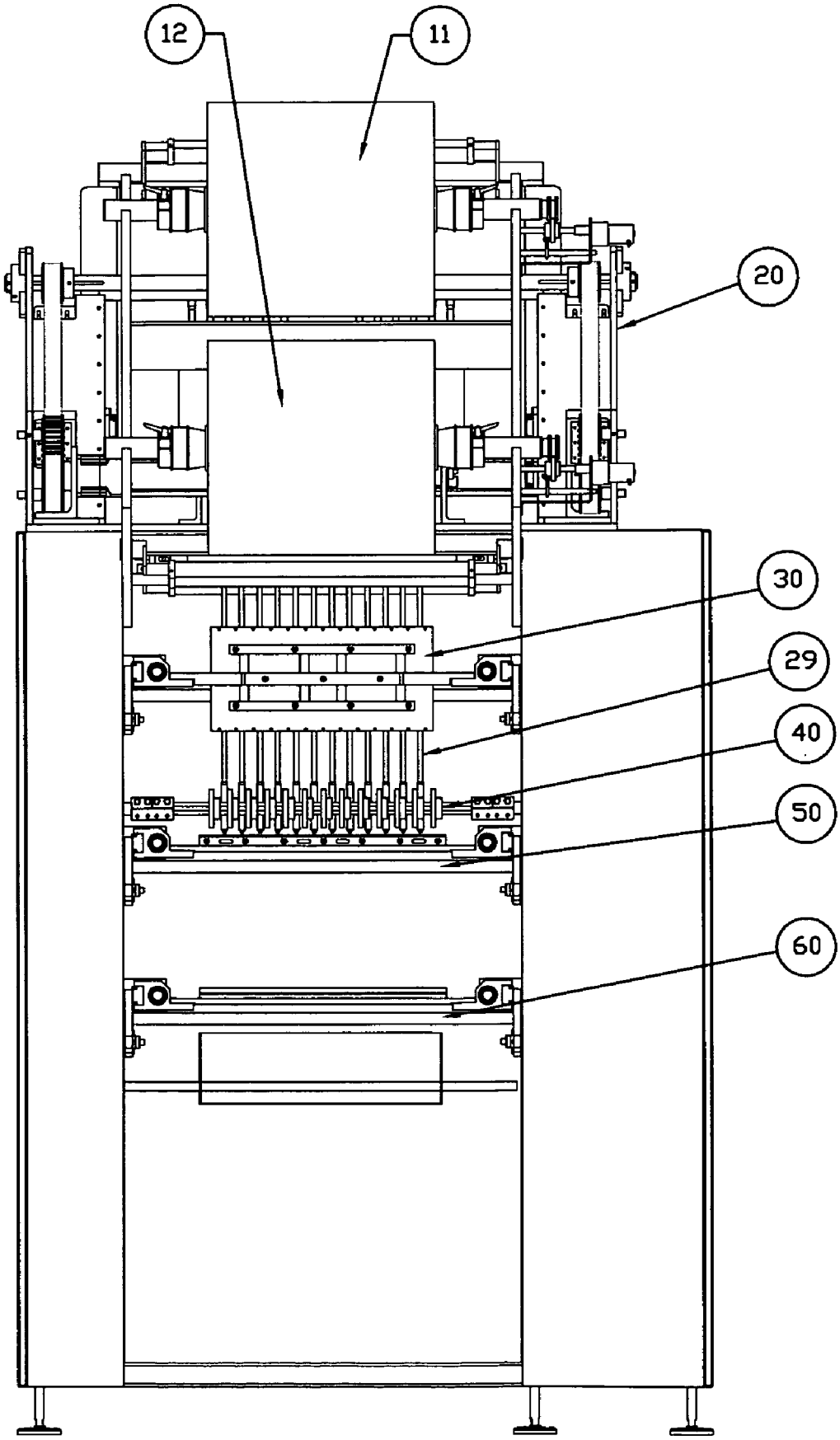
FIG. 2 is a front plan view of the present invention.
Figure 5:
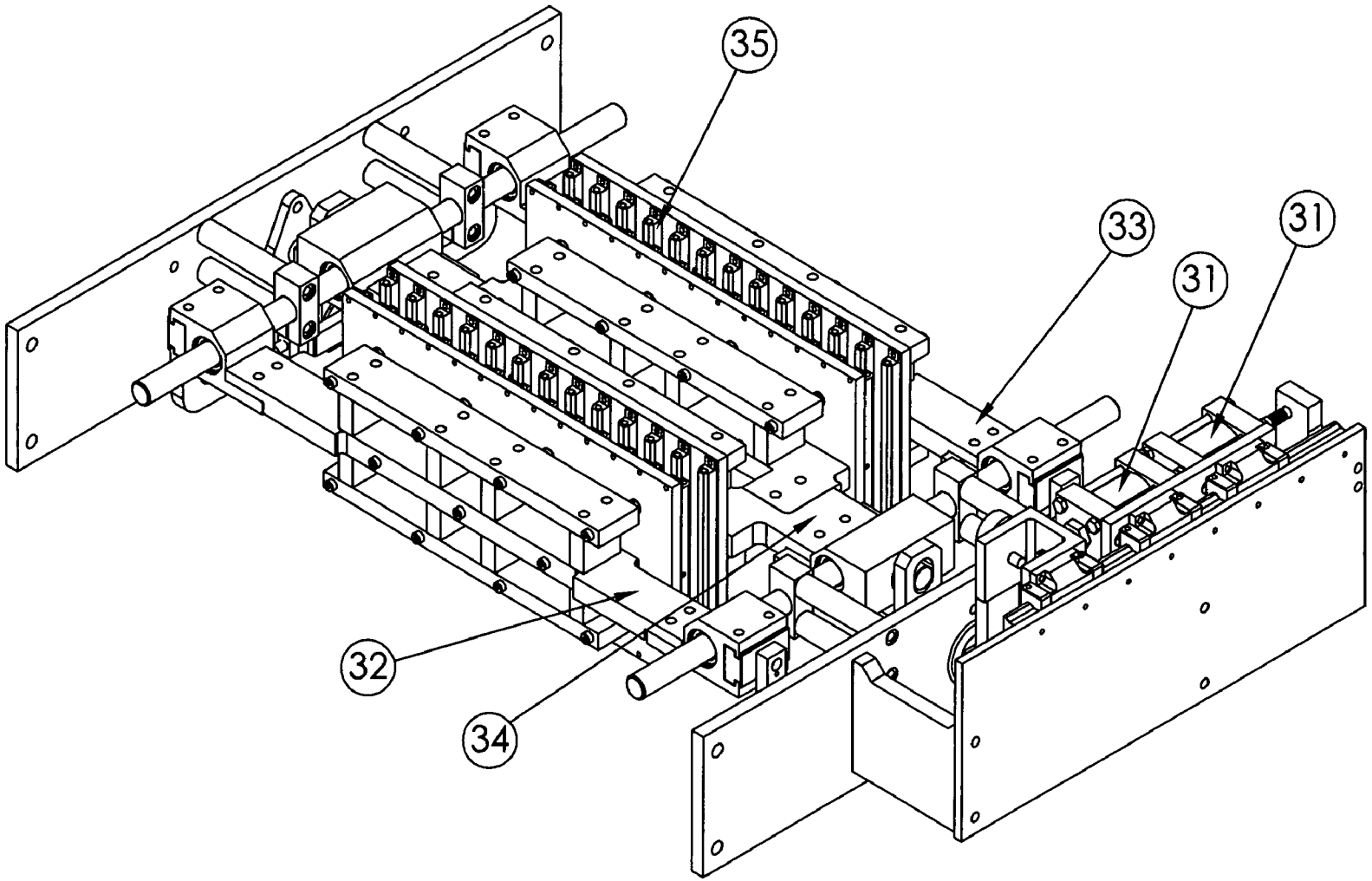
FIG. 5 is an isometric view of a typical double acting side seal station of the present invention.
Figure 9:
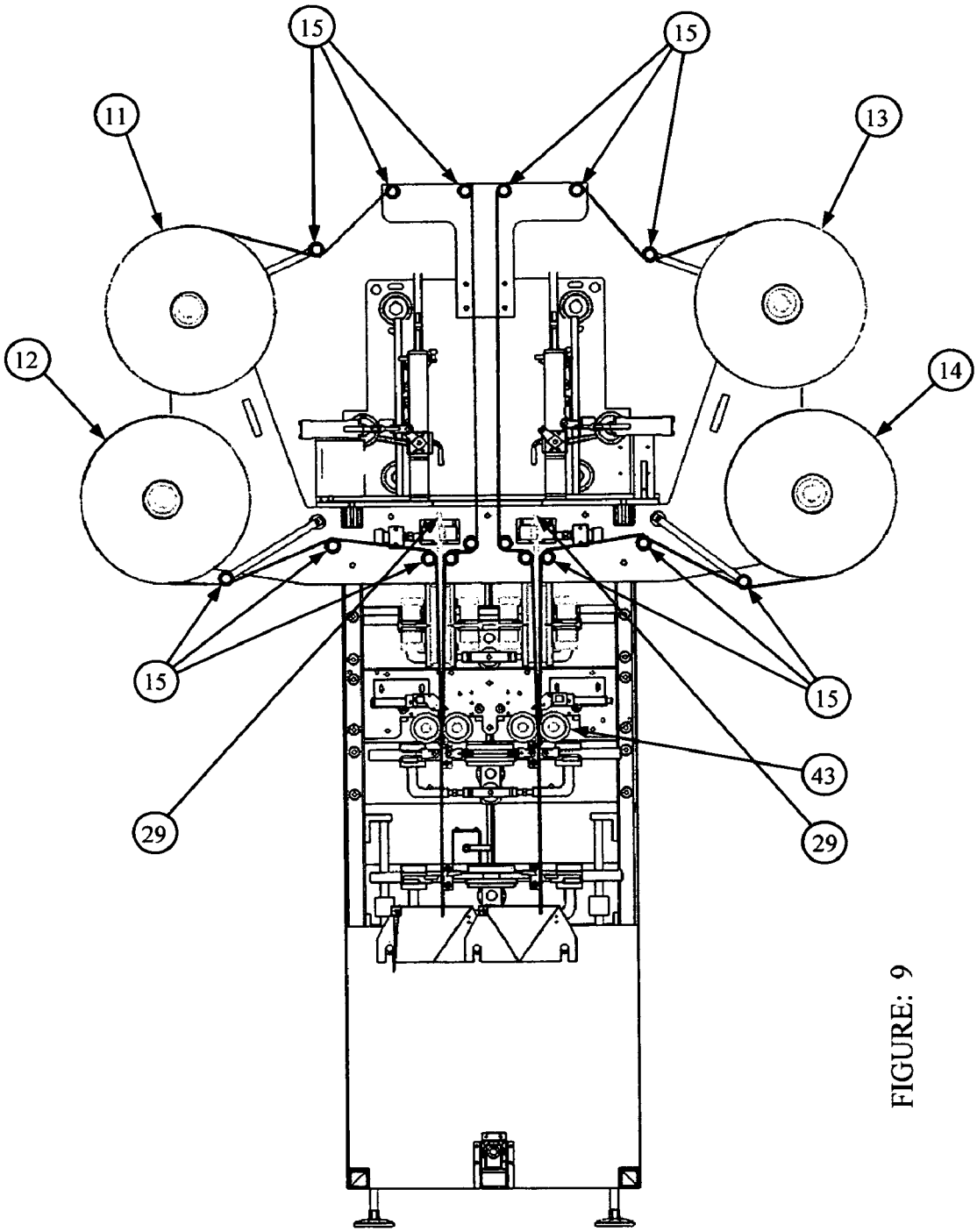
FIG. 9 is a side cut view of the present invention.

In FIGS. 1, 2 and 9 it is seen that the apparatus of the present invention includes a four film dispensing roll station 10 to dispense films to the apparatus; a pump station 20 for insertion of product such as fluids, liquids, viscous, particulated, and dry materials, or other substances into the individual film pouch cavities; a double action side seal station 30 forming the side seals of the individual pouches; a double action pull wheel station 40 advancing (pulling) the films through the machine; a double action cross seal station 50 sealing simultaneously the leading and trailing edges of the pouches; a double action cross cut station 60 separating rows of individual pouches from the film. The preferred way of operation for the various stations is to use servomotors. A alternative way, or combination thereof utilizing two air cylinders 31 to operate the various stations as shown in FIG. 5 may be used to operate one or more of the stations.

Figure 6:
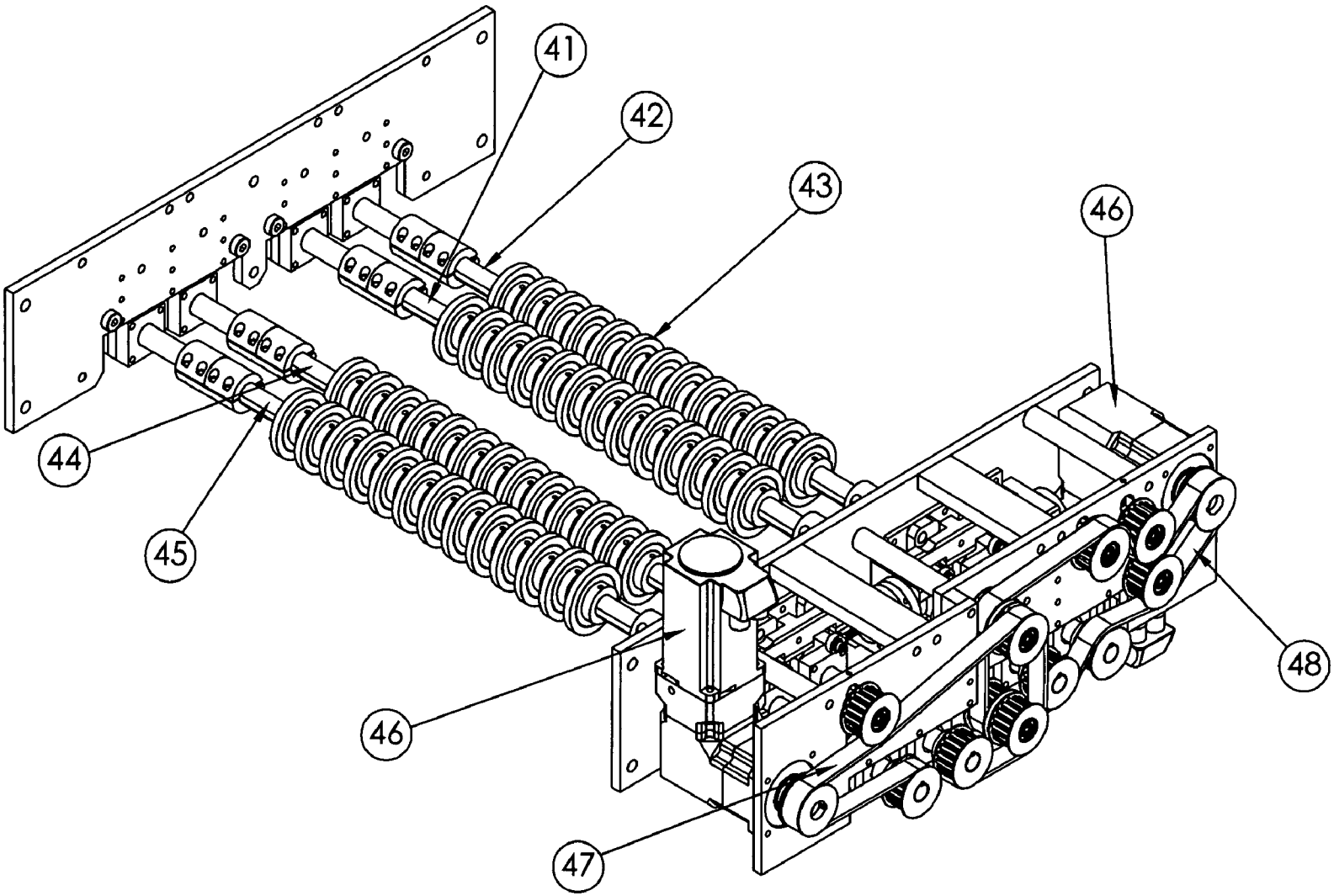
FIG. 6 is an isometric view of a typical double acting pull wheel station of the present invention.

As shown in FIGS. 1, 2 and 9, a first film roll 11, a second film roll 12, a third film roll 13 and a fourth film roll 14 are mounted on the machine in such a manner as to allow the double action pull wheel station FIG. 6 to pull and unroll the film of the four film rolls through the machine, preferably such that the film two sheets each one set of two and a second set of two films that unroll are in parallel relationship to each other as illustrated in FIG. 9. The film from each roll is pulled by the rollers 43 of the double action pull wheel station 40 as shown in FIG. 6. The rotational operation of rollers 43 of the double action pull wheel station 40 results in film from each roll 11, 12, 13, and 14 to be released at an programmed rate of speed. Roll 11 provides film for the back surfaces of the pouches or sachets to be formed in the front half of the machine, while roll 12 provides film for front surfaces thereof. Roll 13 provides film for the back surfaces of the pouches or sachets to be formed in the rear half of the machine, while roll 14 provides film for front surfaces thereof.

Devices such as multiple rollers 15 as depicted in FIG. 9 and four 24 VDC motors 16 as seen in FIG. 1 are provided to properly align and position the sheets of film unrolling off rolls 11, 12, 13 and 14. As illustrated in FIG. 9 the film from roll 11 and 12 are guided to the front main body of the present invention, while the film from roll 13 and 14 are guided to the rear main body of the present invention. As the films are pulled through the double action side seal station 30 they are parallel to, and in close proximity with one another. It is to be understood that several sets of rollers 15 are used to route the two sets of two film layers into the machine into close parallel proximity to each other.

Figure 3:
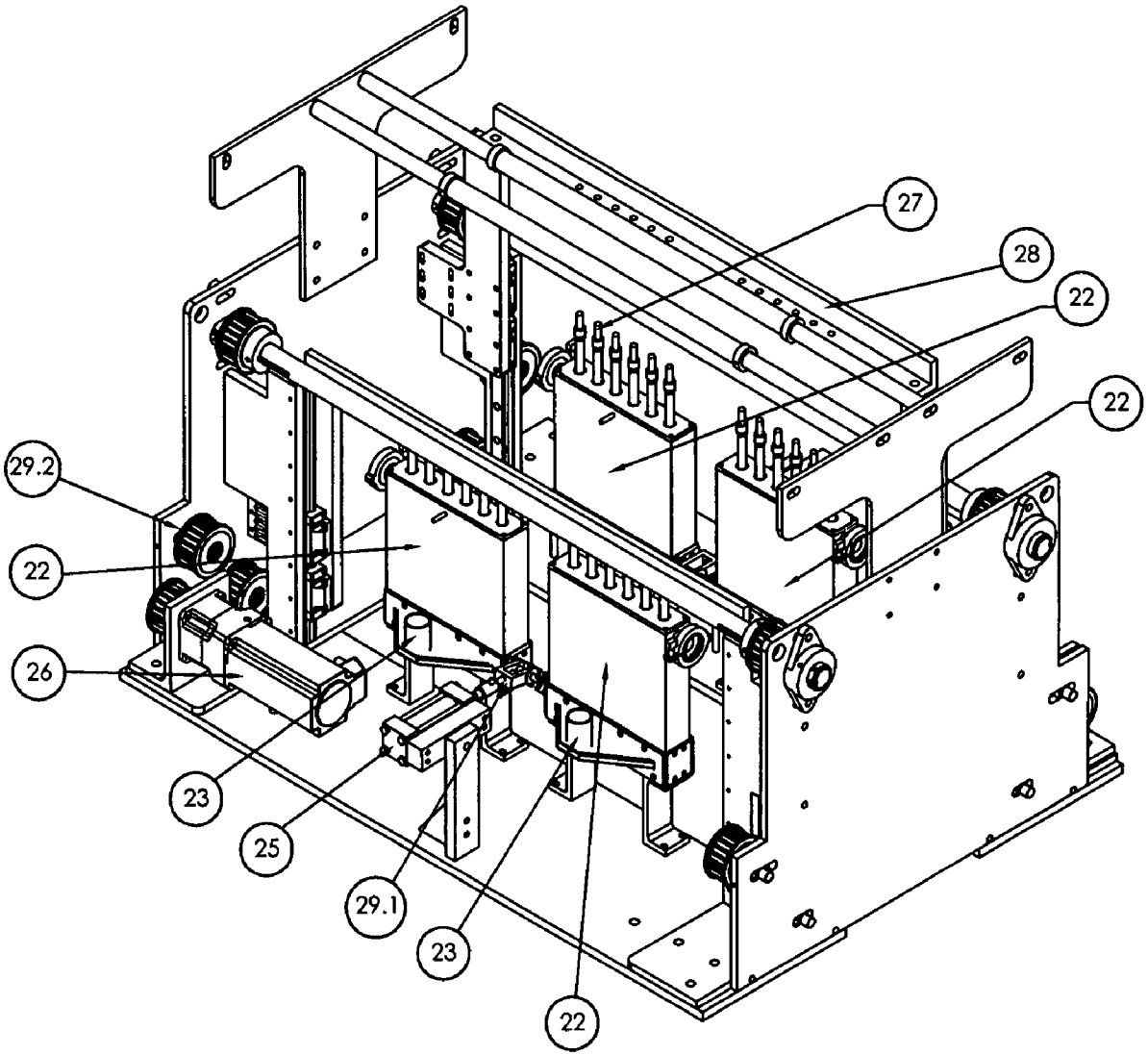
FIG. 3 is an isometric view of a typical pump station of the present invention.
Figure 4:
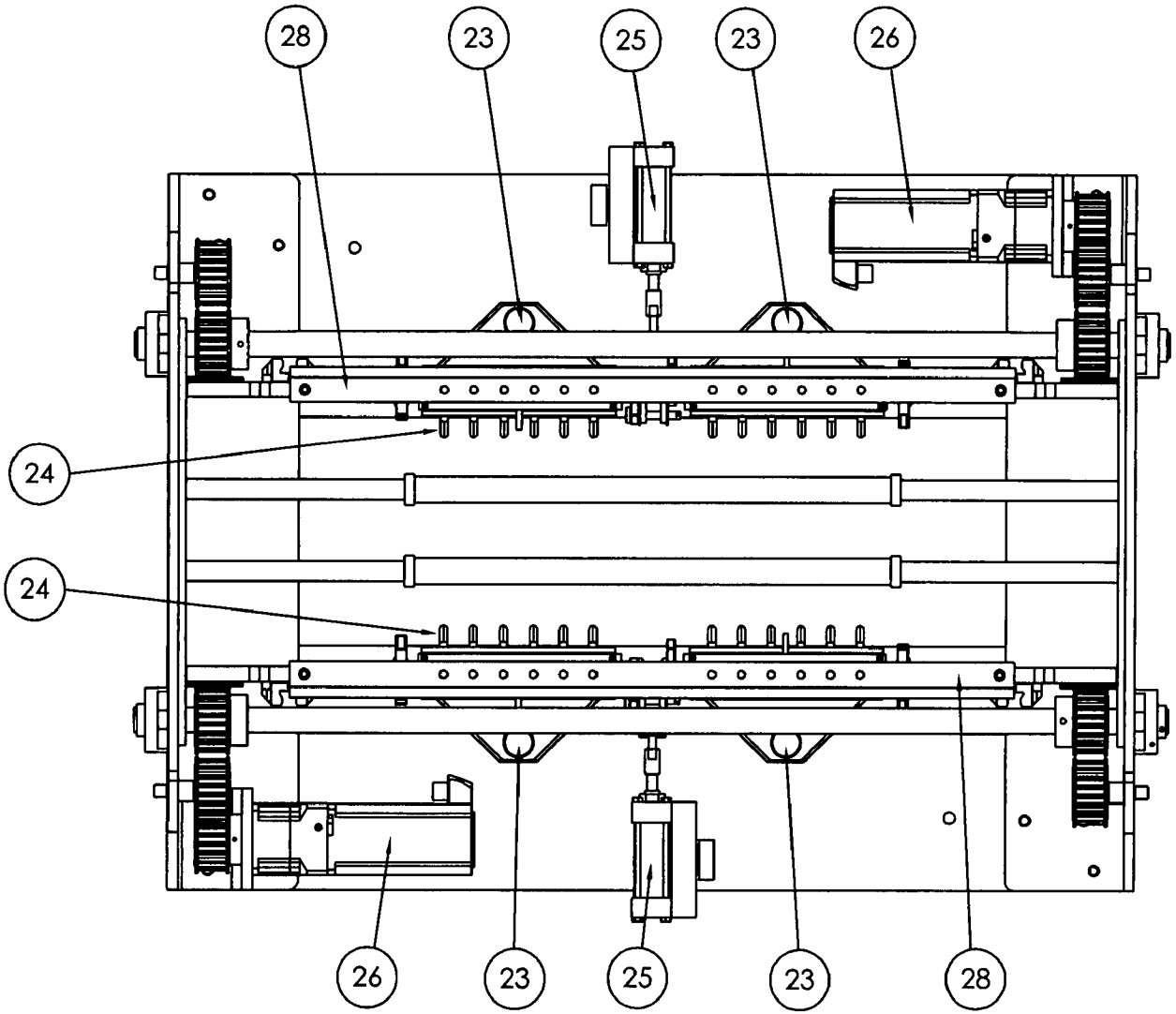
FIG. 4 is a top plan view of a typical pump station of the present invention.

As seen in FIGS. 1, 3 and 4, the pump station 20 contains at least one product dispenser 22, each for front side of machine and backside of machine such dispensers 22 having a product input manifold 23 as seen in FIGS. 3 and 4 attached thereto for receiving the product material (such as mayonnaise, mustard, ketchup etc.) from a overhead tank, pipe or reservoir (not shown). In the current configuration, four such dispensers 22 are provided. A set of output nozzles 24 as seen in FIG. 4 are provided on the other side of the dispensers body and opposite to the intake manifold 23 on station 20, such nozzles 24 are used for discharging product into the individual film pouches formed by the machine. A fill tube 29 is attached to each nozzle 24 as seen in FIG. 2 to deposit the product into each pouch formed, such number of pouches side to side varies depending of the setup configuration of the machine, as shown in the current configuration of the invention the number of pouches formed across the film are twelve. The two sets of fill tubes 29 one set for the front of the machine and one set for the rear of the machine as shown in FIGS. 2 and 9 extend between the two sets of film sheets through the double action side seal station 30, and end between and below the double action pull wheel station 40 seen in FIG. 2 but above the double action cross seal station shown in FIG. 2

The number of fill tubes 29 and distance between them is determined and dependent on the width and number of cavities formed by the machine. For different sized pouches, different dispensers 22 may be used having more or less cavities and different distances between them. If other materials, such as particulated and dry products (e.g. peanuts, rice, sugar, salt, crushed nuts or the like) are to be dispensed a different set of dispensers 22 for the fill station 20 may be substituted, such a configuration requires different intake manifold 23 output nozzles 24 and fill tubes 29.

The preferred method of pumping materials through pump station 20 is accomplished by using servo-motors 26 in conjunction with pistons 27 attached to cross over bars 28 as seen in FIGS. 3 and 4. Each dispenser 22 contains one rotary cutoff valve with multiple ports (not shown) one port for each output nozzle 24. The rotary valve allows in a first position product to enter the dispenser 22 through the manifold 23, and in a second position such product to exit through nozzles 24. The two set of two dispensers 22 independently driven by one servo-motor each 26 one set for the front section of the machine and one set for the rear section of machine are provided so that each set of two is dispensing in conjunction with the rotary valves, output nozzles 24 and fill tubes 29 a measured amount of product from the overhead tank or pipe through the intake manifold 23 into the pouches formed through the stations below.

Each set of two dispensers 22 has two movable levers one for each dispenser (not shown) attached and connected together by a connector and pin 29.1 to operate the internal rotary valve as seen in FIG. 3. One air cylinders 25 each per set of dispensers is used for operation of aforementioned levers. The up and down movement of pistons 27 attached to and controlled by cross over bars 28 are achieved by a set of timing belts (not shown) and pulleys 29.2 which are driven by a servo motor 26 as shown in FIG. 3.

Figure 10:
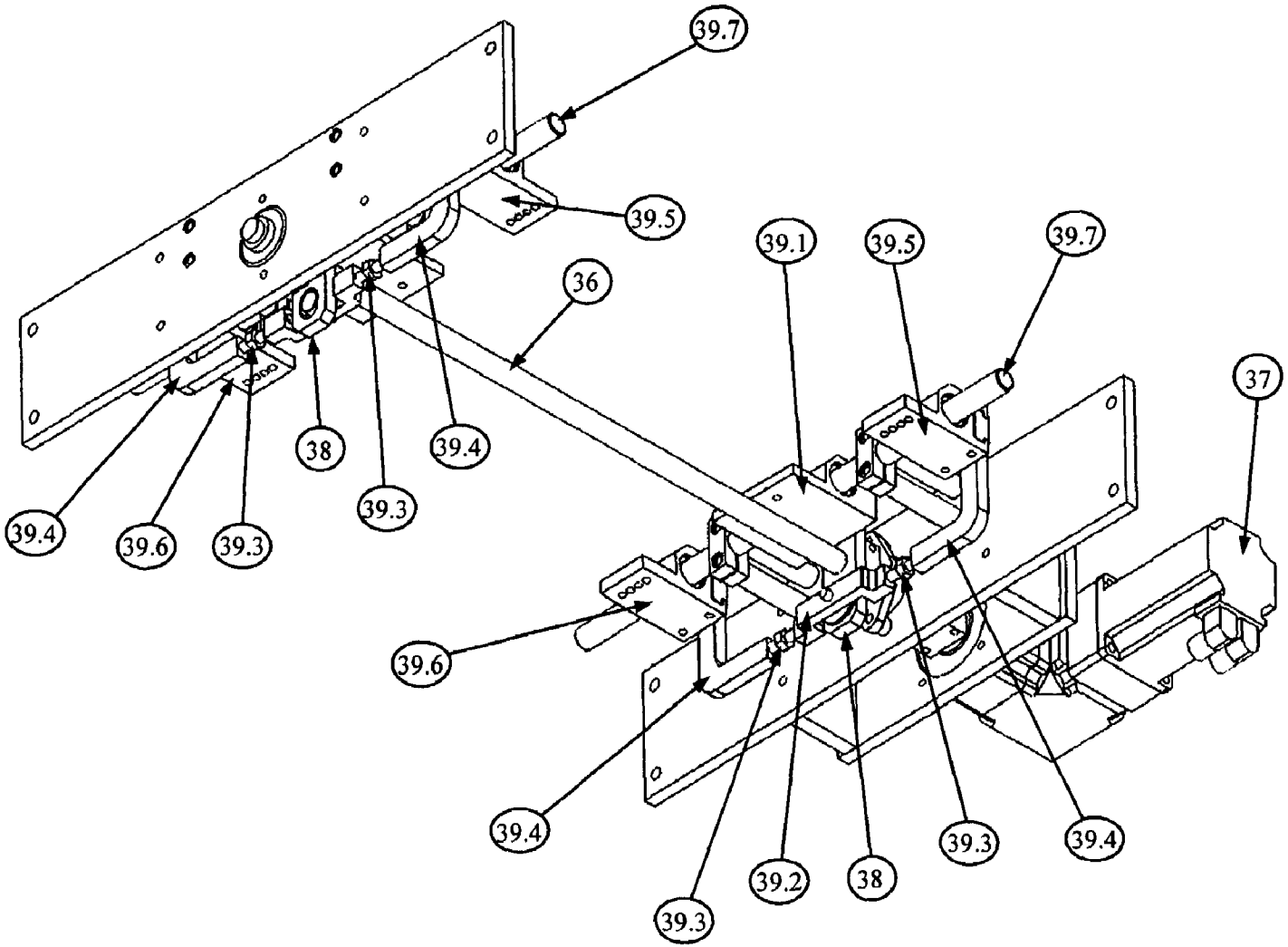
FIG. 10 is an isometric view of a typical drive mechanism for the typical double acting station of the present invention.

As illustrated in FIG. 5, the double action side seal station 30 includes a first or front sealing frame 32 and second or rear sealing frame 33 and a third center sealing frame 34, all positioned in such a manner that the first set of two sets of two films advance between the first frame 32 and third frame 34 while the second set of the two sets of two films advances between frame 33 and frame 34. Multiple vertically oriented sealing pads 35 are affixed to each frame 32, 33 and 34 in a way that pairs of such pads one pad mounted on frame 32 and the second pad of the pair directly mounted opposite on frame 34. The same is repeated between frame 33 and frame 34. The parallel sheets of film from rollers 11 and 12 pass between frames 32 and 34, while the parallel sheets of film from rollers 13 and 14 pass between frames 33 and 34. As the first set of two films passes between the heated pads 35 of frame 32 and 34 each pair of pads pressed together, causes the two films to seal together forming a multitude of longitudinal vertically oriented seals. At the same time the second set of film is being advanced between frame 33 and 34. Once the first set of film has been sealed, the double action station drive system then reverses and the second set of film between pads 35 and frame 33 and 34 is being sealed, while the first set of film as soon as free from contact between the pads 35 and frame 32 and 34 is being advanced and positioned for the next sealing cycle. This process is then repeated over and over. The discharge tubes, also known as fill tubes 29 are positioned so they are located inside the just sealed and formed tubes of film by station 30. Sealing pads 35 are heated using internal heating elements (heater cartridge not shown) and thermocouples (not shown) to control the heat generated by such heater cartridges. The heat generated activates a glue layer incorporated in the film structure allowing the film to adhere to each other creating a seal when heated and pressed together by the sealing pads 35. Referring in more detail to FIG. 5 the sealing frames 32 and 34 and sealing frames 33 and 34 may be in either a release (open) or sealing (closed) position by manipulating the double action side seal station shafts 36 as shown in FIG. 10 which can either be driven by two air cylinders 31 as seen in FIG. 5, or by a servo motor 37 as seen in FIG. 10. The alternating motion between open and close position of the sealing frames 32, 34 and 33, 34 is achieved by rotating shaft 36 approximately 15 degrees in a counter clockwise or 15 degrees in a clockwise direction starting at a neutral center position. Rotating shaft 36 activates lever 38, which in turn is connected to and activates bridge 39.2, and slide block 39.1. Lever 38 which is interconnected to adjustable link 39.3 connecting elbow linkage 39.4 and slide blocks 39.5 and 39.6 which are sliding on shaft 39.7. Rotating lever 38 in any direction causes all interconnected parts to move simultaneously either in a forward or reverse motion on and guided by shaft 39.7. Rotating shaft 36 counter clockwise results in slide block 39.1 connected to lever 38 (connection not visible) to move outward toward the front of machine and slide block 39.5 to move inwards closing the gap applying heat and pressure between the sealing frames 32 and 34, at the same time slide block 39.6 will move outward or in an opposite direction of slide block 39.1 and open the gap between sealing frame 33 and 34 hereby releasing the film from its sealing action grip. Rotating shaft 36 clockwise results in slide block 39.1 to reverse its previous move and move toward the rear of machine and slide block 39.6 to move inwards closing the gap applying heat and pressure between the sealing frames 33 and 34, at the same time slide block 39.5 will move outward or in an opposite direction of slide block 39.1 toward the front of machine and open the gap between sealing frame 32 and 34 hereby releasing the film from its sealing action grip. These motions are repeated time and time again creating 2 sets longitudinal tubes. During each cycle of machine the two sets of two films are either being sealed or advanced, these actions are simultaneous and take place at the same time, while one set of film is being sealed the other set of film is being advanced. Each time the sealing frames 32, 34 and 33, 34 close multiple vertical seals are created hereby forming longitudinal tubes into which after a cross seal 50 is applied the product will be deposited. A neutral position or open position between both sets of sealing frames 32 and 34 and sealing frame 33 and 34 is generally utilized when the apparatus is being prepared for use or when machine maintenance needs to be performed. During such machine setup procedures the operator insert the first set of films from rolls 11 and 12 between the first frames 32 and 34 at the same time the second set of film from rolls 13 and 14 between frame 33 and 34, such films are then brought into contact with the double action pull wheel station 40.

During each cycle of the double action side seal station 30 the sealing pads 35 are forming a predetermined longitudinal seal of approximately eight inches (standard sealing pad length), the film advances a predetermined distance, but never more then, one (1) inch less then the total length of the sealing pads 35, this assures a overlapping of the seals in order to avoid any leaking of the pouches or tubes formed by the sealing pads 35. This motion continues over and over as long as machine is in operation.

The vertical length of sealing pads 35 may be changed so as to provide longer or shorter longitudinal seals, the standard pad length is eight inches. It is to be noted that the cyclical motion of all stations such as double action side seal station 30, double action cross seal station 50 or double action cross cut station 60 are independent from each other and can be operated at different intervals in order to accommodate the various pouch lengths as described below.

Two set of vertically aligned blades, one set for the front of machine and set of films and one for the rear of machine and set of films, theses blades or slitters numbering 1 to 11 on each such set, depending on the configuration of machine are provided just ahead of the double action pull wheel station 40, these blades are cutting along the film path as the film is pulled through the machine separating the newly-formed longitudinal tubes into individual tubes or strips. These blades are situated at the centers of each of the side seals (except at the two outside edges or end seals where no cut is necessary).

As seen in FIG. 6, the double action pull wheel station 40 includes four (4) rotating shafts 41, 42, 44 and 45 each with multiple rollers known as pull wheels 43 positioned in such a manner that each set of opposing rollers 43 pinches one set of film at the same distance matching the distance and position of the just created side seals above matching the with of the to be created pouch and through rotation of the shafts advancing the film through the machine. By rotating shaft 41 clockwise and shaft 42 counter clockwise the rear set of film is being pulled through machine at a predetermined speed and distance. By rotating shaft 44 counter clockwise and shaft 45 clockwise the front set of film is being pulled through machine at a predetermined speed and distance. Roller shafts 41, 42, 44, and 45 are each driven by a servo motor 46 that operates aforementioned shafts by means of a timing belts 47 for operation of the two front shafts and 48 for operation of the rear shafts these belts working in conjunction with timing belt pulleys and the correct routing of such belt causes the shafts to rotate in opposite directions of one another. The speed settings for the pull wheel servos 46 is achieved by the operator entering a setting for the machine speed on the operator interface control panel (not shown) and through the computer controls of the machine which automatically calculates, matches and adjusts the speed or revolutions per minute of the double action pull wheel station 40 to match the cycle speed of the machine.

Figure 7:
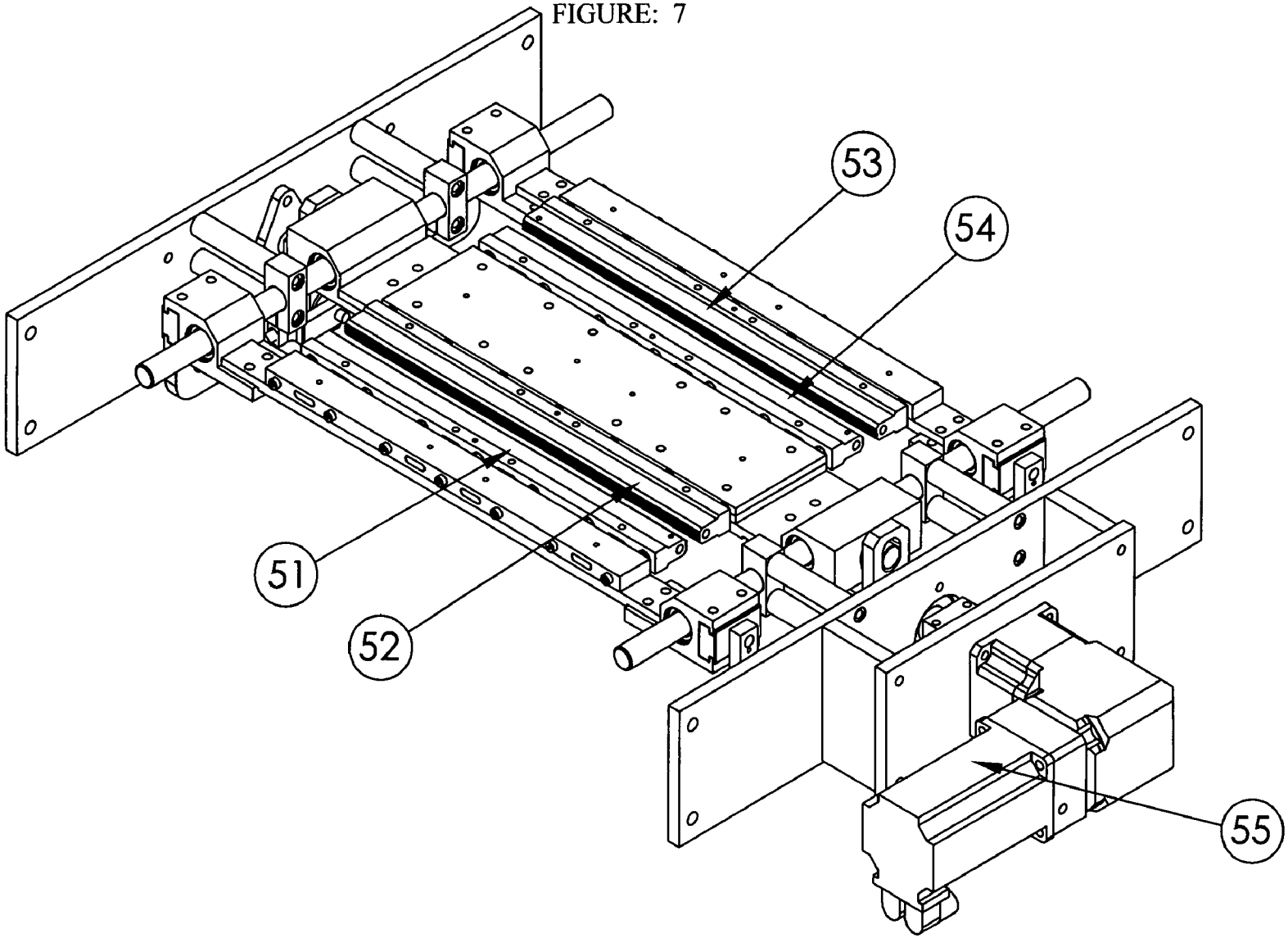
FIG. 7 is an isometric view of a typical double acting cross seal station of the present invention.

The double action cross seal station 50, shown in FIG. 7 which is located downstream along the film path from the double action side seal station 30 and just below the double action pull wheel station 40. The station 50 includes a first cross sealing pad 51 and an opposing second cross sealing pad 52. A third cross sealing pad 53 and a fourth opposing cross sealing pad 54. Pads 51 and 52 are positioned so that the first or front set of two sheets of film advance between them and pads 53 and 54 are positioned so that the second or rear set of two sheets of film advance between them. Sealing pads 51, 52, 53 and 54 are heated using internal heating elements (heater cartridge not shown) and thermocouples (not shown) to control the heat generated by such heater cartridges. The heat generated activates a glue layer incorporated in the film structure allowing the film to adhere to each other creating a seal when heated and pressed together by the sealing pads 51, 52, 53 and 54. Closing sealing pads 51, 52 causes the pads to contact the film surface, providing a combination of heat and pressure upon the contacted surface areas and bonding them to one another to form a transverse or cross seal (typically horizontal) that is perpendicular to the longitudinal or side seals. By reversing the rotation of the servo motor 55 the sealing pads 51 and 52 are releasing their grip on the first or front set of film and as the motion of the servo motor continues sealing pads 53 and 54 are providing a combination of heat and pressure upon the contacted surface areas and bonding them to one another forming a transverse or cross seal for the second or rear set of film hereby completing one full cycle of station 50. This station 50 can be operated with 2 air cylinders 31, which would be used in place of the servo motor 55.

This cycle is then repeated over and over creating 2 sets of cross seals per cycle. The cyclical motion of the double action cross seal station 50 is completely independent from that of the double action side seal station 30 described above, and from that of the double action cross cut station 60, described below. This independence is necessary in order to be able to create longer or multiple seals without cross cutting therefore creating a blanket of pouches rather then independent single pouches.

After the cross seal formation, each longitudinal film tube created by station 30 has now a sealed bottom and sides. As soon as the double action cross seal station 50 releases its grip on the film just sealed the double action pull wheel station 40 is activated and advances the film, simultaneously the pumping or dispensing units from station 20 are also activated and deposit through the fill tubes 29 a predetermined amount of product into the partially finished pouch. This happens at the same time as the other or opposing side of station 50 is creating a cross seal and as described previously ones station 50 releases its grip on the other set of film just sealed the second set of dispensers from station 20 deposits its predetermined amount of product through the second set of fill tubes 29 into the cavities created by the double action side seal station 30 and the double acting cross seal station 50. This process is then repeated over and over as long as the machine is in operation. It is to be noted that each time the double action cross seal station 50 creates a seal it seals the bottom of the longitudinal tubes in order to allow product to be filled into these tubes, at the same time it also creates the top seal of the previously filled pouch hereby sealing the pouch completely on all 4 sides.

Figure 8:
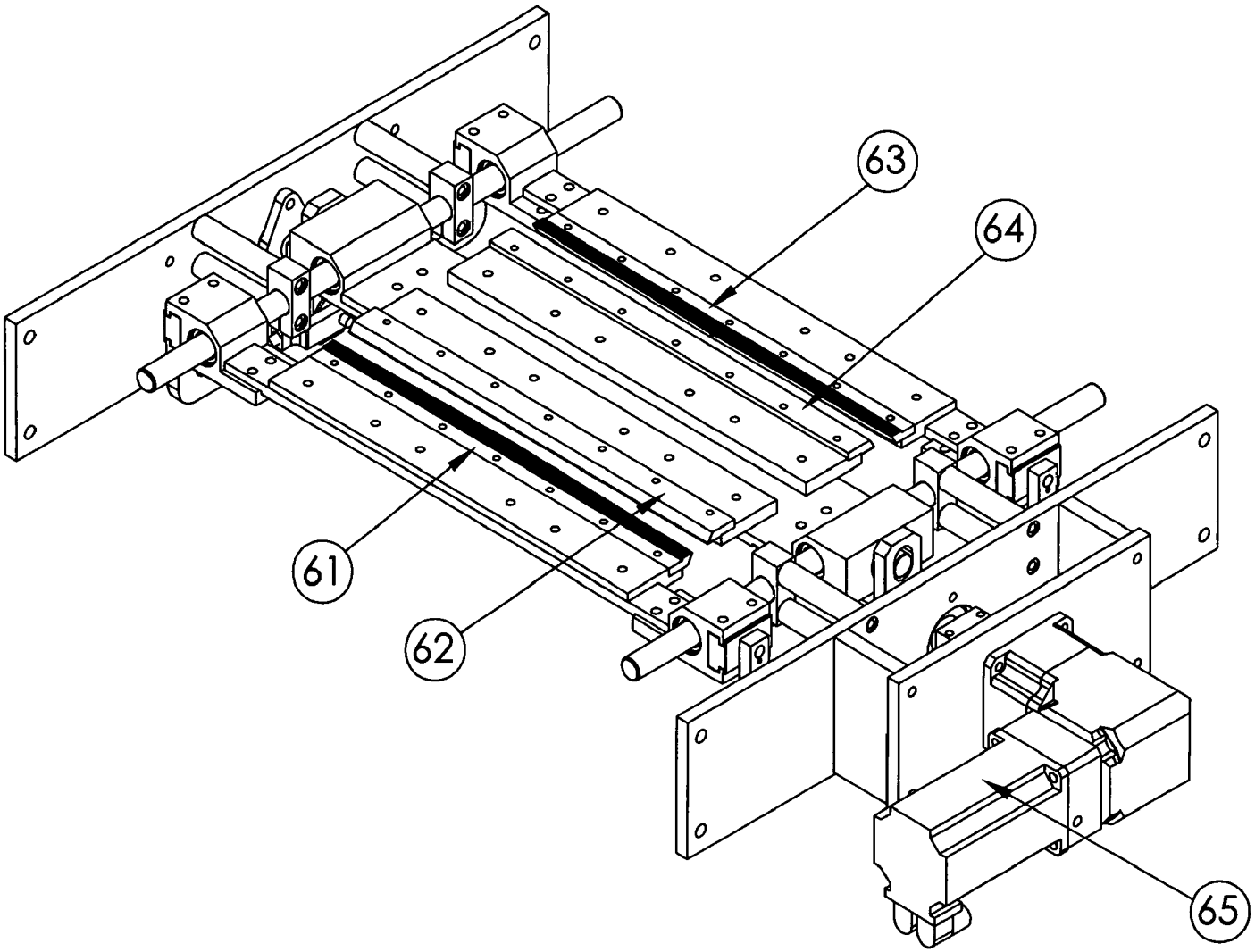
FIG. 8 is an isometric view of a typical double acting cross cut station of the present invention.

The double action cross cut station 60, shown in FIG. 8 which is located downstream along the film path from the double action cross seal station 50. The station 60 includes a first cross cutting blade 61 and an opposing second cross cutting blade 62. A third cross cutting blade 63 and a fourth opposing cross cutting blade 64. Blades 61 and 62 are positioned so that the first or front set of two sheets of film advance between them and blades 63 and 64 are positioned so that the second or rear set of two sheets of film advance between them. Closing cutting blades 61, 62 causes the blades to cut the film, at the previously created transverse or cross seal separating the pouch or pouches from the film. The cut is administered at the center position of the previously created cross seal cutting the seal in half leaving half of the seal which represents the top seal of the pouch or pouches previously sealed by station 50. The other half of the just cut cross seal portion remaining attached to the set of film of the seal previously created by station 50 representing the bottom seal of the pouch or pouches previously sealed by station 50. By reversing the rotation of the servo motor 65 the cutting blades 61 and 62 are retracting while with the continuation of the servo motor 65 rotation cutting blades 63 and 64 are administering their cut to the transverse or cross seal of the second or rear set of film hereby completing one full cycle of station 60. This station 60 can be operated with 2 air cylinders 31, which would be used in place of the servo motor 65.

This cycle is then repeated over and over creating 2 cross cuts per cycle. The cyclical motion of the double action cross cut station 60 is completely independent from that of the double action side seal station 30 and the double action cross seal station 50 described above. This independence is necessary in order to be able to create longer or multiple seals without cross cutting therefore creating a blanket of pouches rather then independent single pouches.

As soon as the double action cross cut station 60 retracts by reversing its motion or rotation from servo motor 65 to move across to make the opposite set of film cut the double action pull wheel station 40 is activated and advances the just cut set of film. This happens at the same time as the other or opposing side of station 60 is creating a cross cut and as described previously ones station 60 retract and reverses its direction to cross over to cut again the first and previously described set of film the double acting pull wheel station 40 will then advance the second set of film. This process is then repeated over and over as long as the machine is in operation. It is to be noted that each time the double action cross cut station 60 cuts a transverse or cross seal it cuts the transverse cross seal in half the lower half of the cut seal now being finished pouches are then discharged out of the machine through various means, such as take of conveyors or containers. The other half of the just cut transverse seal, representing the bottom seal of the next pouch or set of pouches, continues to be attached to the film until the next cycle of the station will cut it or them and so on.

It is to be appreciated that the machine of the present invention is capable of producing pouches of various dimensions. To be specific, pouches formed by the machine have a maximum length limited to 12" the widths of the pouches are limited by the width of the film maximum of 19.5" that may be run through the machine. Depending upon the dimensions of the pouches to be formed the minimum would be 1 pouch and the maximum would be 12 pouches per set of film. The machine is running 2 sets of 2 films through machine and therefore capable of creating anywhere from 2 to 24 pouches per machine cycle.

It is to be understood that other variations and modifications of the present invention may be made without departing from the scope thereof. It is also to be understood that the present invention is not to be limited by the specific embodiments disclosed herein, but only in accordance with the appended claims read in light of the foregoing specification.

What is claimed is:

1. A machine for making pouches from 2 sets of 2 webbed film materials and filling said pouches with a product comprising:

a. a support structure on said machine for holding two pair of rolls of said film material and two sets of separate vertical fill tubes;

b. an apparatus for gripping and unrolling film from each of said pair of rolls and for forming two separate continuous tubes, one tube from each pair of films around each said fill tubes;

c. multiple product dispensers for inserting product into the pouches thorough said two set of fill tubes as they are being formed;

d. a first station supporting 2 sets of separated pairs of opposing vertically aligned closable heat sealing bars for the formation of 2 sets of multiple longitudinal seals upon said 2 pair of film to join and bond said film together along the contact area of each of said pair of seals;

e. two separate sets of multiple stationary blades each blade situated in a position such as to cut through and along said vertically sealed film along the path of the previously created side seal separating said seals and film into longitudinal tubes:

f. a second station supporting two separate independent operable pairs of opposing closable pull wheels to advance said pair of film through machine;

g. a third station supporting two separated pairs of opposing closable heat sealing members for the formation of transverse or horizontal seals at predetermined intervals upon said pairs of film to join and bond said films together along each of said seals;

h. a fourth station supporting 2 separated pairs of knife blade assemblies for cutting across the centers of said transverse seals; and i. servo motors for driving each set of said vertical heat sealing bars, pull wheels, horizontal seal members and knife blades;

j. control means for driving the servo motors so that a first group of vertical heat sealing bars, pull wheels, horizontal seal members and knife blades operate on a first film tube while holding the second group vertical heat sealing bars, pull wheels, horizontal seal members and knife blades inoperative on the second fill tube and then reversing the drive of said servo motors to reverse the operation of said two groups so that said first group is inoperative and said second group is operative on their respective film tubes.

2. The machine of claim 1 wherein each of said first, second, third and fourth stations are capable of independent movement of each other of said stations.

3. The machine of claim 1 wherein said second station consisting of four horizontal, independently moveable paired parallel shafts, each set of shaft containing a minimum of 2 pairs or up to a maximum of 13 pairs of rollers positioned in such alignment that each of paired rollers are in line with the vertically aligned seal bars of said first station pulling film through the machine at predetermined speeds and frequencies.

4. The machine of claim 1 wherein a multitude of fill tubes attached to the dispensing units are provided, each individual fill tube positioned between said sheets of film and between said side seal bars and pull wheels.

5. The machine of claim 4 and said dispensers containing multiple pistons for pulling in a measured quantity of product from a overhead supply tank or piping and dispense said quantity of product through said fill tubes into said pouches as they are being formed.

6. The machine of claim 1 wherein said transverse or horizontal seals are perpendicular to said longitudinal seals.

7. The machine of claim 1 wherein said 2 sets of multiple vertically oriented stationary blades are positioned downstream from said longitudinal heat sealing members.

8. The machine of claim 1 wherein said film roll support structure is positioned on top of said machine, and multiple guides are provided to said support structure to align and bring the individual sheets of film from each roll into close parallel proximity with each other forming 2 parallel pairs of film while entering and passing through the machine.

* * * * *